US005328114A

United States Patent [19]

Boldrini et al.

[11] Patent Number: 5,328,114

[45] Date of Patent: Jul. 12, 1994

[54] DEVICE FOR REMOVING ADHESIVE TAPE FROM A REEL OF STRIP MATERIAL

[75] Inventors: Fulvio Boldrini, Ferrara; Antonio Gamberini, Bologna, both of Italy

[73] Assignee: G.D Societa' Per Azioni, Bologna, Italy

[21] Appl. No.: 987,585

[22] Filed: Dec. 8, 1992

Related U.S. Application Data

[63] Continuation of Ser. No. 673,740, Mar. 22, 1991, abandoned.

[30] Foreign Application Priority Data

Mar. 27, 1990 [IT] Italy ..... 3413-A/90

[51] Int. Cl.[5] ..... B65H 16/00

[52] U.S. Cl. ..... 242/562; 156/344; 156/584

[58] Field of Search ..... 242/55, 78.8; 156/344, 156/584; 219/10.491, 10.492, 10.61; 83/170, 171

[56] References Cited

U.S. PATENT DOCUMENTS

| | | | |
|---|---|---|---|
| 2,681,771 | 6/1954 | Haskell | 242/56 A |
| 2,761,941 | 9/1956 | Ardichvilli | 219/10.492 |
| 3,066,882 | 12/1962 | Havens et al. | 242/56 A |
| 3,442,733 | 5/1969 | Vilcins | 83/170 X |
| 3,866,642 | 2/1975 | Walser | 83/170 X |
| 3,874,975 | 4/1975 | Lagain | 156/515 |
| 4,245,795 | 1/1981 | Ludszeweit et al. | 242/56 R |
| 4,688,736 | 8/1987 | Brinker et al. | 242/78.8 X |
| 4,690,724 | 9/1987 | Outlaw | 219/229 X |
| 4,721,263 | 1/1988 | Miyazaki | 242/55 |
| 4,840,320 | 6/1989 | Shigeta et al. | 242/55 X |
| 4,984,750 | 1/1991 | Shigeta et al. | 242/78.8 X |
| 5,096,134 | 3/1992 | Sakano | 242/78.8 X |

FOREIGN PATENT DOCUMENTS

| | | | |
|---|---|---|---|
| 2007250 | 6/1983 | Fed. Rep. of Germany | 83/170 |
| 3816775 | 8/1988 | Fed. Rep. of Germany | 242/55 |
| 662935 | 12/1951 | United Kingdom | 219/10.61 |
| 2238777 | 6/1991 | United Kingdom | 242/66 |

*Primary Examiner*—John M. Jillions
*Attorney, Agent, or Firm*—Marshall, O'Toole, Gerstein, Murray & Borun

[57] ABSTRACT

A device for removing, from a reel of strip material, an adhesive tape secured to a peripheral surface portion of the reel via thermoplastic adhesive material; which device comprises a pair of rollers supporting the reel; one of the rollers being a drive roller for rotating the reel about its axis; at least one heating element located close to the peripheral surface of the reel and designed to substantially contact the tape; and the other roller having vacuum openings for removing the tape from the peripheral surface of the reel subsequent to the adhesive material being plasticized by the heating element.

13 Claims, 1 Drawing Sheet

FIG.1
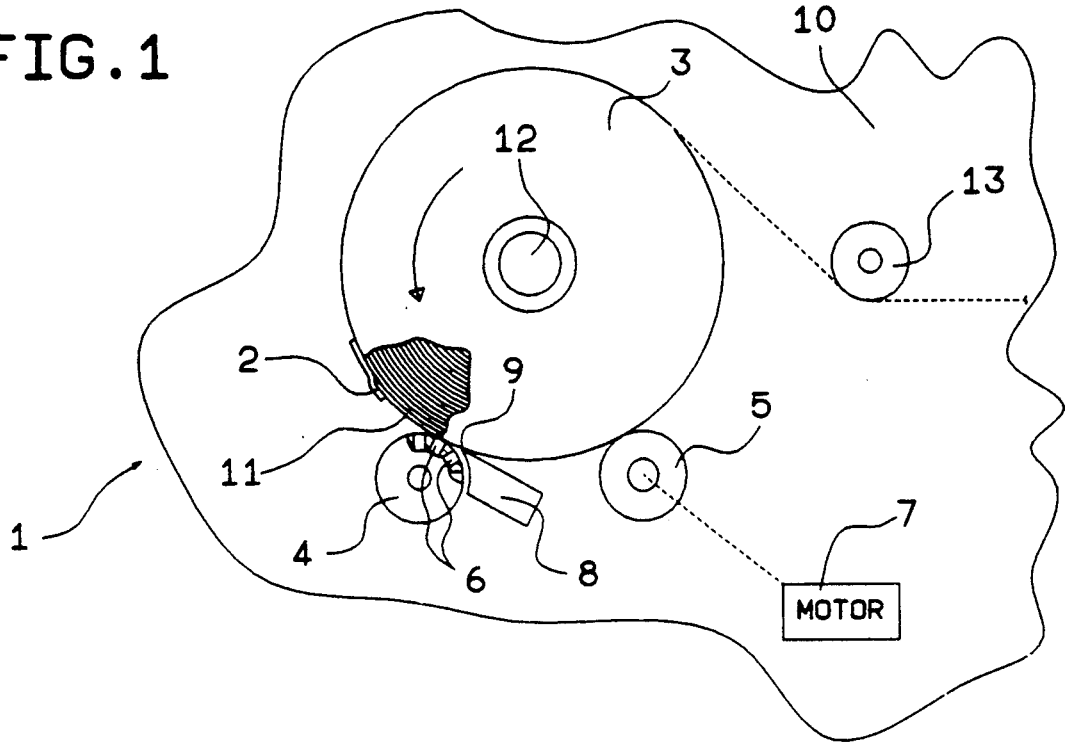
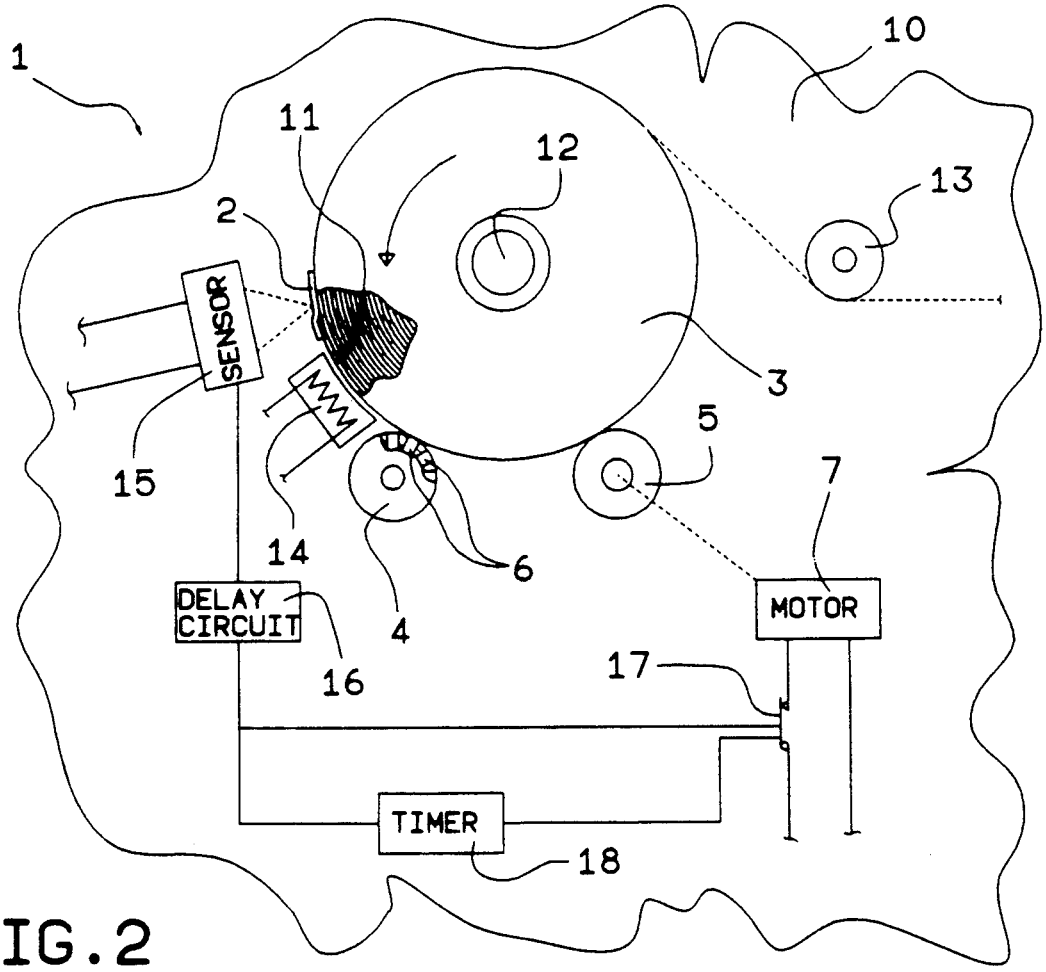
FIG.2

DEVICE FOR REMOVING ADHESIVE TAPE FROM A REEL OF STRIP MATERIAL

This application is a continuation of application Ser. No. 07/673/740, filed Mar. 22, 1991, now abandoned.

BACKGROUND OF THE INVENTION

The present invention relates to a device for removing adhesive tape from a reel or roll of strip material. Reels of packing material are normally supplied with a strip of adhesive tape affixed to the first counter turn of the reel for preventing this from unrolling or working loose during transport or handling prior to use.

On non-automated plants, the adhesive tape is removed manually by the operator prior to use.

On automated plants, the reels are fed automatically to the user equipment, where the starting end of the new reel is either spliced to or run on automatically after the run-off reel. To do this, automatic devices must be provided for removing the adhesive tape from the first turn of the reel.

Devices do exist, such as the one referred to in British Patent No. 2,035,966, whereby the first turn of the new reel, to which the adhesive tape is affixed, is cut off by appropriate cutting means and the resulting portion of strip material removed via pickup means.

In addition to being fairly complex, such a device fails to safeguard against the underlying turns of the reel also being damaged by the cutting means employed.

SUMMARY OF THE INVENTION

The aim of the present invention is to provide a device for removing adhesive tape from a reel of strip material, which is relatively straightforward in design and provides for reliable performance with absolutely no risk of damage to the reel.

With this aim in view, according to the present invention, there is provided a device for removing adhesive tape from a reel of strip material, said adhesive tape being affixed to a peripheral surface portion of said reel via thermoplastic adhesive material; characterized by the fact that it comprises means for supporting said reel; at least one heating element located close to the peripheral surface of said reel and designed to substantially contact said tape; and removing means for removing said tape from the peripheral surface of said reel subsequent to said adhesive material being plasticized by said heating element.

BRIEF DESCRIPTION OF THE DRAWINGS

Two non-limiting embodiments of the present invention will be described by way of example with reference to the accompanying drawings, in which:

FIG. 1 shows a schematic view of a first embodiment of the device according to the present invention;

FIG. 2 shows a schematic view of a second embodiment of the device according to the present invention.

DETAILED DESCRIPTION OF THE INVENTION

Number 1 in FIG. 1 indicates a device for removing adhesive tape 2 from a reel or roll 3 of strip material. During operation of device 1, the axis of reel 3 is arranged horizontally, with reel 3 supported underneath on means comprising a left and right roller 4 and 5 (FIG. 1) the axes of which are arranged horizontally and parallel to each other and to the axis of reel 3. Roller 4, hereinafter also referred to as the pickup element, is idle, and presents a number of peripheral radial openings or channels 6 connected, in known manner not shown, to a suction source (not shown). Roller 5 is connected to drive means comprising a reversible motor represented schematically by block 7.

A heating element, consisting of a plate 8 heated in known manner and having a sharp edge 9, is supported on base 10 of device 1, close to roller 4 and between this and roller 5, with edge 9 substantially contacting the lower peripheral surface of reel 3.

As shown in FIG. 1, strip 11 of which reel 3 is composed is wound clockwise on to core 12 of reel 3, and, as is normally the case, adhesive tape 2 is affixed to the periphery of reel 3 by a coating of thermoplastic adhesive material.

When device 1 is operated, reel 3 is rotated counterclockwise by roller 5, during which rotation, tape 2 is brought repeatedly into contact with edge 9 of hot plate 8. This eventually softens the thermoplastic adhesive coating securing tape 2 to the peripheral portion of reel 3, until edge 9 finally manages to wedge itself between the edge of tape 2 and the peripheral surface of reel 3, so as to gradually detach tape 2.

As it is detached, tape 2 adheres to the peripheral surface of roller 4, by which it is retained by suction and conveyed in known manner to a known collecting station (not shown). Plate 8 and roller 4 may thus be considered removing means for detaching tape 2 off reel 3 and disposing of the same.

Motor 7 is then stopped in known manner and reversed, so as to enable reel 3, the end of which is now released, to be rotated clockwise by roller 5.

As reel 3 is rotated, the end of strip 11 is fed in known manner to a station, shown schematically by roller 13, where it is spliced automatically and in known manner to the end of the run-off reel (not shown).

In the FIG. 2 variation of device 1, the heating element comprising plate 8 is dispensed with and, immediately upstream from roller 4 (with reference to counterclockwise rotation of reel 3), provision is made, close to the peripheral surface of reel 3, for a heating element 14 supported on base 10 and consisting of a heated block having a curved surface skimming the peripheral surface of reel 3.

Immediately upstream from heating element 14 (with reference to counterclockwise rotation of reel 3), base 10 supports a known optical sensor 15 for detecting the passage of tape 2 as reel 3 is rotated. Sensor 15 is connected to a known delay circuit 16 designed, under given conditions described later on, to open a contact 17 on the electrical supply line to motor 7. Delay circuit 16 is also connected to a timer 18 designed, under given conditions described later on, to close contact 17.

When device 1 in FIG. 2 is operated, reel 3 is rotated counterclockwise by roller 5. On detecting the passage of tape 2, sensor 15 supplies a signal to delay circuit 16 which, by the time tape 2 reaches the curved surface of heating element 14, opens contact 17 to arrest motor 7. Tape 2 is arrested adjacent to heating element 14 until timer 18 closes contact 17 so as to start up motor 7 in the same direction as previously. By the time motor 7 is started, the thermoplastic adhesive coating on tape 2 has been softened by heating element 14 so that, on reaching roller 4, tape 2 is gripped and retained by suction and conveyed to said collecting station (not shown ) .

Motor 7 is then arrested and reversed in known manner, thus enabling reel 3, the end of which is now released, to be rotated clockwise by roller 5, so as to feed the end of reel 3 to said station shown schematically by roller 13.

As will be evident from the above description, for removal of tape 2 after the tape has been heated and softened by the hot plate 8 or heating element 14, reel 3 is rotated in the take-up direction of the strip material, i.e., the direction in which the roll is rotated in order to take up strip material. In FIGS. 1 and 2, the take-up direction is counterclockwise. This is the same direction in which roll 3 is rotated in order to remove tape 2 from the periphery of the roll.

To those skilled in the art, numerous changes may be made to device 1 as described and illustrated herein without, however, departing from the scope of the present invention.

For example, provision may be made for both plate 8 and block 14, for facilitating detachment of tape 2 from the peripheral surface of reel 3.

Moreover, the heating element for softening the adhesive material securing tape 2 to the peripheral surface of reel 3 may be of any design, and a number of heating elements may be employed if necessary.

The embodiments of device 1 described and illustrated herein clearly provide for achieving the aims of the present invention in terms of efficiency and highly straightforward design.

We claim:

1. A device for removing adhesive tape from a roll of wound strip material, the adhesive tape being affixed to a portion of a peripheral surface of the roll by thermoplastic adhesive material, the device comprising:

support means for the roll, the roll being mounted on said support means to be rotatable about an axis;

drive means for rotating the roll about said axis in a strip material take-up direction in which the strip material is taken up onto the roll;

at least one fixed heating element close to said peripheral surface; and adhesive tape removing means arranged at a first location in relation to the roll, and adapted to remove said tape from said peripheral surface after the adhesive material is plasticized by heat from the heating element and with the reel rotating in said strip material take up direction.

2. A device according to claim 1 wherein said heating element comprises a fixed heating plate having a sharp edge close to the peripheral surface of the roll, said sharp edge defining, at least in part, said removing means.

3. A device according to claim 1 wherein said heating element comprises a fixed heating block having a curved surface closely facing, in use, said peripheral surface when the roll is rotated about said axis by said drive means.

4. A device according to claim 3 wherein detecting means are provided to detect said tape on said peripheral surface; and said drive means being controlled by said detecting means to stop the roll with said tape arranged adjacent to the heating element.

5. A device according to claim 4 wherein said removing means comprise a pick-up element adapted to pick-up and thereby remove said tape from the roll subsequent to said adhesive material having been plasticized by heat from the said heating element.

6. A device according to claim 5 wherein said pick-up element comprises a rotary roller and suction means extending over at least part of a peripheral surface of the roller for removing the adhesive tape from the roll.

7. A method of removing an adhesive tape from a roll of wound strip material, with the adhesive tape being affixed to a portion of a peripheral surface of the roll by thermoplastic adhesive material, comprising:

supporting the roll on a supporting means so that the roll is rotatable about an axis;

rotating the roll about said axis in a strip material take-up direction in which the strip material is taken up on the roll;

heating the adhesive tape, by means of a fixed heating element substantially contacting the said peripheral surface, until the adhesive material is plasticized; and with the reel rotating said strip material take-up direction, removing the heated adhesive tape from the roll peripheral surface by a removing means arranged at a fixed location relative to the roll.

8. A method according to claim 7 in which:

the strip material has a starting end which is held in place by the adhesive tape overlapping said strip starting end; and after the adhesive tape is removed the roll is rotated in a direction in which the strip is unwound and the strip starting end is delivered to a location to be fed into strip user equipment.

9. A method according to claim 7 in which:

the reel is continuously rotated while the adhesive tape is heated; and when the thermoplastic adhesive material has been plasticized by being heated the adhesive tape is scraped free of the roll periphery and is fed to the removing means.

10. A method according to claim 8 in which:

the fixed heating element has a heated curved surface facing the roll peripheral surface.

11. A method according to claim 8 in which:

rotation of the roll is stopped when the adhesive tape is adjacent the heating element and the roll remains stopped until the thermoplastic adhesive material is plasticized by heat from the heating element; and then the heating is stopped and the roll is rotated until the removing means removes the heated adhesive tape from the roll peripheral surface.

12. A method according to claim 11 in which:

the strip material has a starting end which is held in place by the adhesive tape overlapping said strip starting end; and after the adhesive tape is removed the roll is rotated in a direction in which the strip is unwound and the strip starting end is delivered to a location to be fed into strip user equipment.

13. A method according to claim 7 in which the removing means includes suction means and the heated adhesive tape is removed from the roll periphery by suction applied to said tape by the suction means.

* * * * *